US006830324B2

(12) United States Patent
Ogura et al.

(10) Patent No.: US 6,830,324 B2
(45) Date of Patent: Dec. 14, 2004

(54) LIQUID STORING CONTAINER, INK JET CARTRIDGE, AND INK JET PRINTING APPARATUS

(75) Inventors: Hideki Ogura, Kanagawa (JP); Hiroyuki Ishinaga, Tokyo (JP); Nobuyuki Kuwabara, Tokyo (JP); Tetsuya Ohashi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 10/329,373

(22) Filed: Dec. 27, 2002

(65) Prior Publication Data

US 2003/0122909 A1 Jul. 3, 2003

(30) Foreign Application Priority Data

Dec. 27, 2001 (JP) ..... 2001-398213

(51) Int. Cl.[7] ..... B41J 2/175
(52) U.S. Cl. ..... 347/86; 347/87
(58) Field of Search ..... 347/6–7, 85, 86, 347/87, 92

(56) References Cited

U.S. PATENT DOCUMENTS

| | | | | |
|---|---|---|---|---|
| 4,422,084 A | | 12/1983 | Saito | 346/140 R |
| 4,509,062 A | | 4/1985 | Low et al. | 346/140 R |
| 4,673,955 A | | 6/1987 | Ameyama et al. | 346/140 R |
| 5,440,333 A | | 8/1995 | Sykora et al. | 347/87 |
| 5,600,358 A | * | 2/1997 | Baldwin et al. | 347/87 |
| 5,608,437 A | * | 3/1997 | Iwata et al. | 347/86 |
| 5,754,207 A | * | 5/1998 | Gragg et al. | 347/86 |
| 5,767,882 A | * | 6/1998 | Kaplinsky et al. | 347/87 |
| 5,896,151 A | * | 4/1999 | Miyazawa et al. | 347/86 |
| 6,250,751 B1 | * | 6/2001 | Whitney et al. | 347/87 |
| 2003/0035036 A1 | | 2/2003 | Ogura et al. | 347/86 |
| 2003/0067518 A1 | | 4/2003 | Ishinaga et al. | 347/85 |
| 2003/0067520 A1 | | 4/2003 | Inoue et al. | 347/86 |

FOREIGN PATENT DOCUMENTS

| | | | |
|---|---|---|---|
| EP | 0924081 A2 * | 6/1999 | B41J/2/175 |
| JP | 56-67269 | 6/1981 | |
| JP | 6-226993 | 8/1994 | |

* cited by examiner

*Primary Examiner*—Anh T. N. Vo
(74) *Attorney, Agent, or Firm*—Fitzpatrick, Cella, Harper & Scinto

(57) ABSTRACT

In an ink storing container, movable members are properly constructed by molding sheet material into a convex form and are properly welded to a frame. The ink storing container is provided with an air passage section in which an ink meniscus is formed correspondingly to pressure relative to the atmosphere and through which the interior of an ink storing space is in communication with the atmosphere via an air path having a predetermined length. Thus, when negative pressure in the storing space increases, an air is introduced into the space via the air passage section. On the other hand, when the gas in the ink storing section expands to push the ink in the storing space, the ink can be kept in the path. As a result, the interior of the ink storing space is maintained at appropriate negative pressure for ink supply.

19 Claims, 18 Drawing Sheets

LIQUID STORING CONTAINER, INK JET CARTRIDGE, AND INK JET PRINTING APPARATUS

This application claims priority from Japanese Patent Application No. 2001-398213 filed Dec. 27, 2001, which is incorporated hereinto by reference.

BACKGROUND OF THE INVENTION

1. Field of the Invention

The present invention relates to a liquid storing container, an ink jet cartridge, and an ink jet printing apparatus, and more specifically, to a liquid storing container formed of a sheet member in order to store a liquid such as ink supplied to, for example, a pen as a printing section or an ink jet printing head.

2. Description of the Related Art

Containers for storing a liquid have conventionally been known which are based on a method of supplying a liquid while maintaining the interior of the container at negative pressure. With this method, the negative pressure in the container is maintained within an appropriate range for a liquid use section such as a pen point or a printing head which is connected to the container. Thus, while the liquid is not used, it is appropriately prevented from leaking from the liquid use section. Further, when the liquid is used, it is properly supplied in response to a variation in pressure associated with the use.

In the field of ink jet printing, known negative pressure generating mechanisms used inside the container include a sponge as a negative pressure generation source which is stored inside an ink tank as a liquid storing container and a bag-like ink housing section provided with a spring to generate negative pressure by exerting force against inward deformation of the bag resulting from consumption of ink (refer to Japanese Patent Application Laid-open Nos. 56-067269 (1981), 6-226993 (1994), and the like). Another known negative pressure generating mechanism is a conical configuration with a rounded conical portion which is thinner than the peripheral surface of the cone, e.g. the rubber ink storing section disclosed in U.S. Pat. No. 4,509,062.

On the other hand, a method has been known which comprises determining the appropriate range of negative pressure for the liquid use section on the basis of a pressure head difference (a difference in pressure caused by a difference in height between the liquid use section and the container), as opposed to the method of maintaining negative pressure in the container using the above negative pressure generating mechanisms. This method does not require any special mechanisms for the liquid storing section and thus often uses a liquid storing bag formed of a sheet member such as a bag. However, this method requires a specified difference in height between the liquid storing bag and the liquid use section (a printing head or the like). Accordingly, a supply tube or the like is interposed between the liquid storing bag and the liquid use section. This results in a tendency to increase the size of the apparatus.

On the contrary, a liquid storing section provided with any of the above negative pressure generating mechanisms does not require any pressure head differences. This enables the liquid storing container and the liquid use section to be contact with each other. For example, in the field of ink jet printing, a configuration has been known in which an ink tank provided with a negative pressure generating mechanism is integrated with an ink jet printing head. In the specification, such a configuration in which a printing head and an ink tank are integrated together is called an "ink jet cartridge". Furthermore, such ink jet cartridges can be roughly classified into configurations in which the printing head and the ink tank are always integrated together and configurations in which the printing head and the ink tank are separate from each other, can each be separated from the apparatus main body, and are integrated together for use.

In any of the above configurations, to allow the efficient use of ink stored in the ink tank, an ink supply port in an ink storing section is provided below the center of the ink tank positioned for use. Correspondingly, the printing head is located below the ink supply port. Thus, the negative pressure generating mechanism must determine the appropriate range of negative pressure for the printing head considering in particular the effects of the gravity on ink. Such negative pressure forms back pressure in connection with the supply of ink to the printing head and makes the pressure in ejection openings in the printing head negative with respect to the atmospheric pressure. This is why it is called "negative pressure".

One of the most known negative pressure generating mechanisms is the use of capillary force of a porous member. An ink tank configured in this manner has a porous member such as a sponge filled into the entire tank and preferably compressed in it. Further, this configuration is provided with an air communication port. This arrangement prevents an increase in negative pressure in the tank associated with ink consumption, thus allowing ink to be supplied smoothly.

However, it is unavoidable that ink is less efficiently stored in an ink tank using a porous member as a negative pressure generating mechanism, because of the presence of the porous member. To decrease this problem, a known configuration stores ink only in a part of the ink tank instead of inserting it into the entire ink tank. This configuration installs a porous member close to the ink supply port in the ink tank to maintain a predetermined negative pressure to the printing head within an appropriate range. It also directly stores ink on a side further from the ink supply port without using any porous members. This configuration allows ink to be stored more efficiently than the configuration in which the porous member is filled into the entire ink tank. It also allows ink to be supplied appropriately to the printing head.

However, in terms of ink storing efficiency, the use of a porous member as a negative pressure generating mechanism is still insufficient, and the bag-like container composed of a combination of a bag and a spring or the rubber ink tank, described previously, is more excellent.

The known mechanism in which a bag-like ink storing container is provided with a spring to generate negative pressure relates to an ink storing container with a relatively large capacity (for example, 30 cc to 40 cc). Thus, the spring exerts strong force in order to generate negative pressure. Accordingly, a sheet deformed depending on the amount of ink is relatively less rigid. Thus, the rigidity or deformation of the sheet associated with ink consumption does not significantly affect negative pressure generated. That is, it creates no problems in a practical sense though it may make ink supply variable or unstable to some degree.

However, if an ink storing container of a relatively small capacity (for example, less than 30 cc) is formed of a sheet and a spring-based negative pressure generating mechanism is provided, then a new problem may occur particularly owing to a relatively increased sheet rigidity.

For example, if an ink storing container is manufactured by expanding a planar sheet and sticking or welding it to a frame while maintaining its shape, then it is relatively difficult to keep the sticking or welding surface of the sheet flat. Thus, the sheet may wrinkle, or assembly stability or the reliability of sticking may be degraded.

Further, this bag-like ink storing container is a closed system. Accordingly, when only a little ink is left in the container as a result of consumption, the ink may not be used up because of an increase in negative pressure caused by displacement of the sheet or wrinkles formed in the deformed portion. This means that an ink storing container of a small capacity not only stores only a small amount of ink but also provides only a small amount of ink available. This may be a practical problem.

Furthermore, if impact during distribution or a change in environment such as temperature causes a significant change in pressure in the ink storing container, then that change cannot be absorbed by deformation of the sheet. As a result, ink may leak or may be supplied inappropriately.

SUMMARY OF THE INVENTION

It is an object of the present invention to provide a liquid storing container, an ink jet cartridge, and an ink jet printing apparatus which can be manufactured reliably, which enable a liquid to be used up appropriately, and in which liquid supply is unlikely to be affected by a change in environment.

In the first aspect of the present invention, there is provided a liquid storing container from which a liquid is supplied to an exterior and in which the liquid is stored, the liquid storing container comprising:

a deformable movable member which form the container and has a portion molded into a convex form;

negative pressure generating means for applying force to the movable member, an applying direction of the force being a direction opposite to a direction in which the movable member is deformed as the liquid is supplied, to maintain the interior of the container at negative pressure with respect to atmosphere; and an air passage section including an air introduction port in which a liquid meniscus is formed corresponding to pressure relative to the atmosphere and a path having a predetermined length so that the interior of the container communicates with the atmosphere via the path and the air introduction port.

In the second aspect of the present invention, there is provided an ink jet cartridge comprising:

an ink storing container from which ink is supplied to an exterior and in which the ink is stored, the ink storing container including:

a deformable movable member which form the container and has a portion molded into a convex form;

negative pressure generating means for applying force to the movable member, an applying direction of the force being a direction opposite to a direction in which the movable member is deformed as the ink is supplied, to maintain the interior of the container at negative pressure with respect to atmosphere; and an air passage section including an air introduction port in which an ink meniscus is formed corresponding to pressure relative to the atmosphere and a path having a predetermined length so that the interior of the container communicates with the atmosphere via the path and the air introduction port, and a printing head ejecting the ink, which is supplied from the ink storing container.

In the third aspect of the present invention, there is provided an ink jet printing apparatus which performs printing by using a printing head to eject ink to a printing medium, wherein the ink jet printing apparatus uses an ink storing container from which ink is supplied to the printing head and in which the ink is stored, the ink storing container including:

a deformable movable member which form the container and has a portion molded into a convex form;

negative pressure generating means for applying force to the movable member, an applying direction of the force being a direction opposite to a direction in which the movable member is deformed as the ink is supplied, to maintain the interior of the container at negative pressure with respect to atmosphere; and an air passage section including an air introduction port in which an ink meniscus is formed corresponding to pressure relative to the atmosphere and a path having a predetermined length so that the interior of the container communicates with the atmosphere via the path and the air introduction port.

With the above configuration, the movable member is molded into a convex form, so that even the liquid storing container of a small capacity can maintain a stable capacity. Further, the movable member can exhibit predetermined rigidity. Furthermore, the movable member can remain planar when fixed to, for example, a frame. Therefore, when the movable member is welded or stuck, problems such as wrinkling of their welding or sticking surfaces can be prevented.

Further, the ink storing container is provided with the air passage section in which a meniscus is formed correspondingly to pressure relative to an atmosphere and in which the interior of the liquid storing space is in communication with the atmosphere via the path having a predetermined length. This allows an air to be introduced into the space via the air passage section, when the negative pressure in the storing space increases. On the other hand, when the air in the liquid storing space expands to push the liquid out the storing space, the liquid can be kept in the path.

The above and other objects, effects, features and advantages of the present invention will become more apparent from the following description of embodiments thereof taken in conjunction with the accompanying drawings.

BRIEF DESCRIPTION OF THE DRAWINGS

FIGS. 12A, 12B, and 12C are sectional views of the ink storing container shown in FIG. 11, wherein FIG. 12A is taken along a ZX plane in FIG. 11, FIG. 12B is taken along an XY plane, and FIG. 12C shows the ink storing container as viewed from an X direction, in which side portions of an enclosure member have been removed;

DETAILED DESCRIPTION OF PREFERRED EMBODIMENTS

Embodiments of the present invention will be described below in detail.

Embodiment 1

Figure 1:
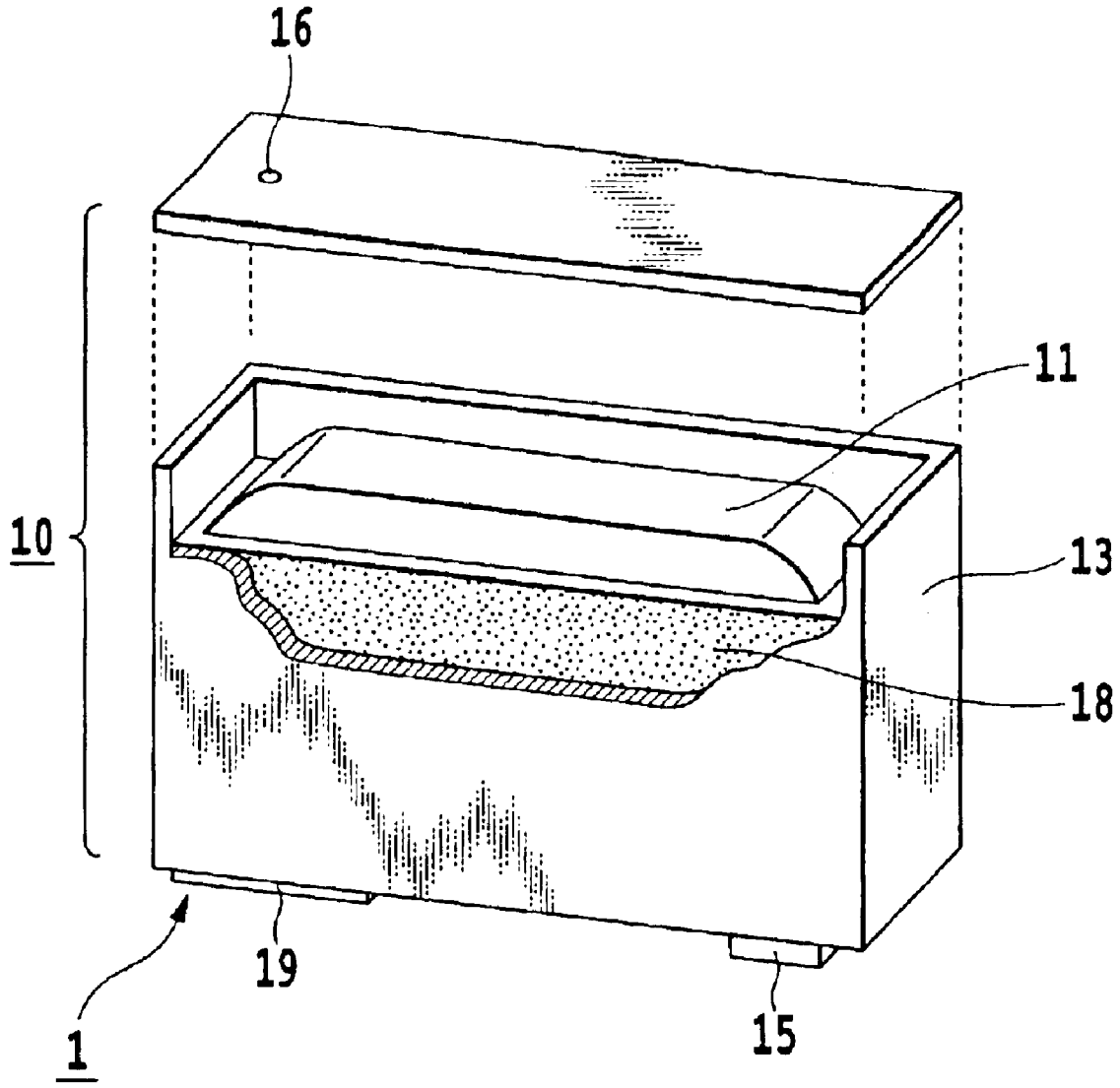
FIG. 1 is a partly broken perspective view showing an ink storing container as a liquid storing container according to an embodiment of the present invention.
Figure 2:
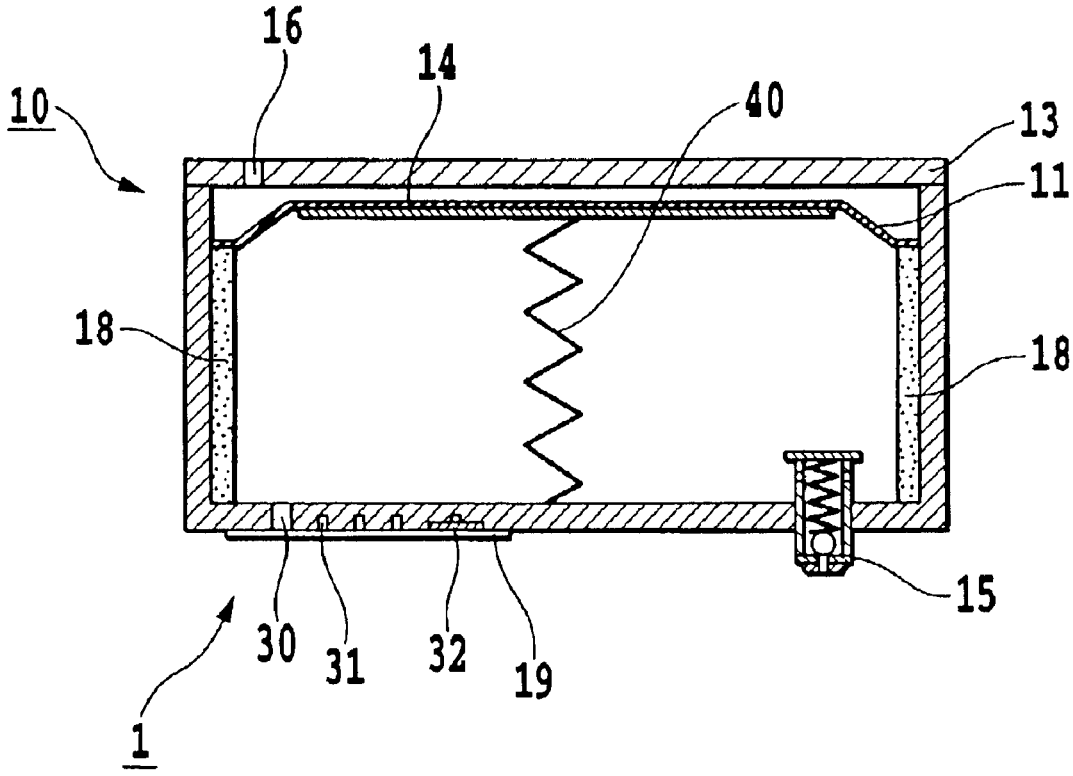
FIG. 2 is a sectional view of an ink storing container shown in FIG. 1.

FIG. 1 is a partly broken perspective view of an ink storing container as a liquid storing container according to an embodiment of the present invention. FIG. 2 is a sectional view of the ink storing container in FIG. 1.

As shown in these figures, in an ink storing container 10, an storing space is formed of a movable member 11 and a bottom member acting as a frame 18 and part of an enclosure member 13. Since the ink storing container 10 includes the enclosure member 13, partly provided with an air communication port 16, in particular the movable member 11 is protected from external impact or the like.

The movable member 11 is obtained by molding a deformable flexible film (a sheet member) into a convex form, and is shaped like a trapezoid in a side sectional view, as shown in FIG. 2. Further, a plate 14 is attached to the movable member 11 inside its plane constituting its convex top, and the plate 14 can be deformed in peripheral portions of its top. Further, a spring 40 is provided substantially in the center of a storing space. That is, one end of the spring 40 is attached to the plate 14, with the other end attached to the bottom, also acting as the enclosure member 13. The movable member 11 is basically displaced (deformed) depending on the amount of ink in the storing space so that balance is kept between upward force exerted by the spring 40 and negative pressure generated in the storing space. In this case, side portions of the movable member 11 are stretched or contracted in a well-balanced manner, so that the top of the movable member 11 can move up and down while maintaining its horizontal position. This smooth deformation (displacement) of the movable member 11 prevents impact caused by rapid deformation or an abnormal variation in pressure.

Furthermore, once the movable member 11 is displaced down to the lowest end of its displaceable range, the force of the spring 40 no longer changes with tension acting on the movable member 11 depending on the current negative pressure. The position of the movable member 11 remains unchanged, but the negative pressure is adjusted to an appropriate value by introducing air through an air passage section, described later.

The ink storing container 10 also comprises an ink supply port 15 through which ink stored in the container is supplied to a printing head, and an air passage section 1 through which an air is externally introduced when the negative pressure reaches a predetermined value relative to the atmospheric pressure. The air passage section 1 is composed of an air introduction port 30, an air path 31, a film 32, and a cover 19 for them as described later in FIG. 6 and other figures in detail.

Figure 3:
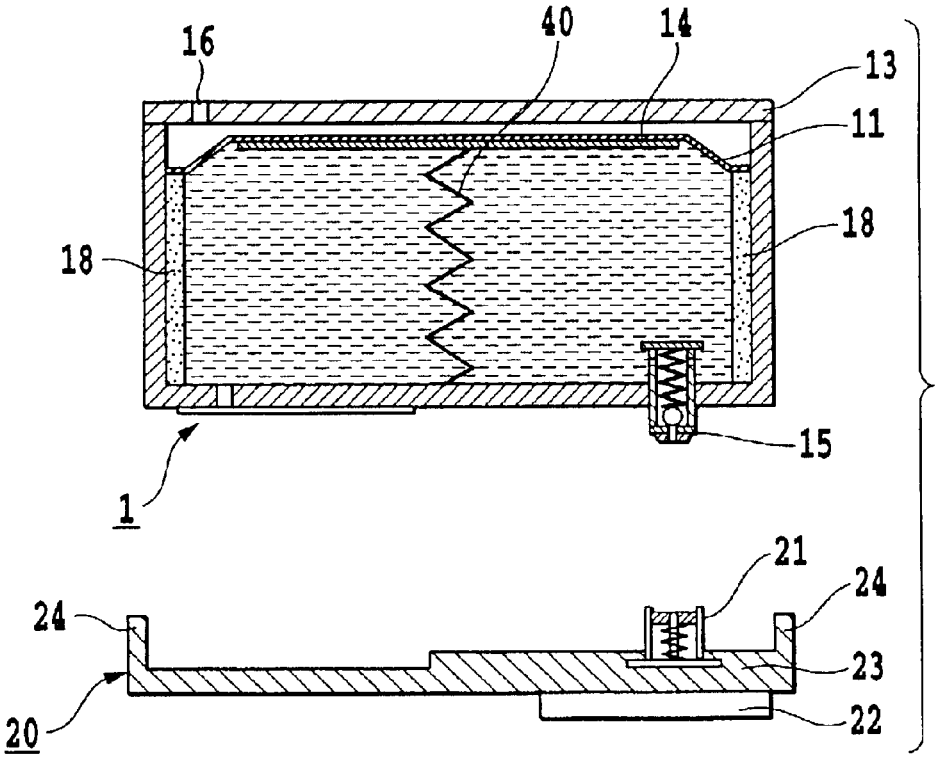
FIG. 3 is an exploded view of an ink jet cartridge composed of the ink storing container and a printing head which ejects ink supplied from the container.

FIG. 3 shows an ink jet cartridge composed of the above described ink storing container 10 and a printing head 20 which ejects ink supplied from the container. In this figure, the ink storing container and other components are disassembled.

As shown in this figure, the printing head 20 comprises a head tip 22 provided with ink ejection openings and ink paths communicating with the ejection openings respectively and joint 21 that connects with an ink supply port 15 in the ink storing container 10 to enable ink to be supplied to the head tip 22. An ink supply path from the joint 21 to the head tip 22 is provided with a filter to prevent bubbles and dust from entering the head tip 22. The head tip 22 is provided with an electro-thermal converting element in each ink path to allow bubbles to be generated in ink utilizing thermal energy generated by the element so that the pressure of the bubbles causes the ink to be ejected. The printing head 20 has holders 24 formed at its opposite ends to hold the ink storing container 10 when joined to it.

Figure 4A:
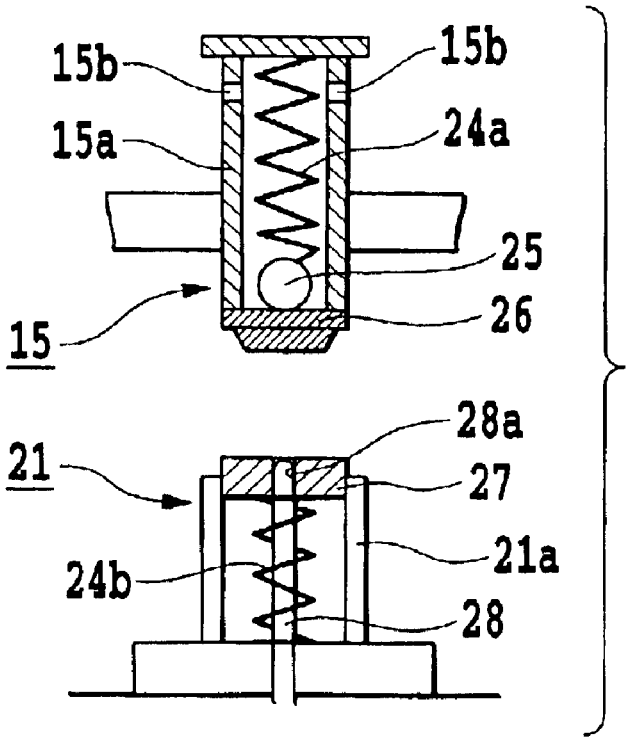
FIGS. 4A and 4B are views illustrating the details of an ink supply port and a joint in the ink storing container and their connection.
Figure 4B:
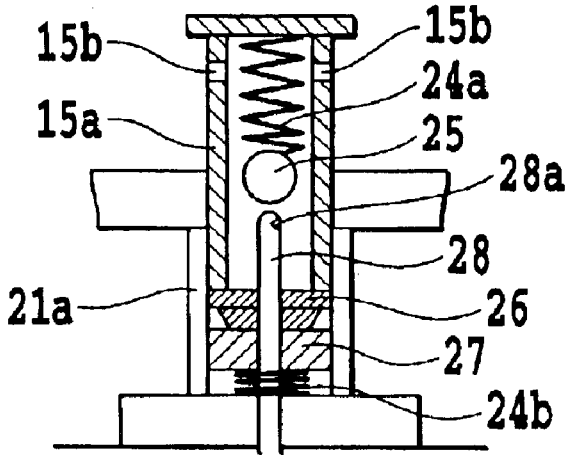

FIGS. 4A and 4B illustrate the details of the ink supply port 15 and the joint 21 and the connection between them.

As shown in FIG. 4A, the ink supply port 15 in the ink storing container comprises a hollow cylindrical base member 15*a*, and a ball 25 and a spring 24*a* both of which are provided inside the base member 15*a*, the spring 24*a* urging the ball 25 against rubber 26. The rubber 26 is attached to an end of the base member 15*a* and is provided with a slit. Further, the base member 15*a* has a hole 15*b* formed in its upper part to allow the interior of the base member 15*a* to communicate with the ink storing space. The ink in the storing space flows into the base member 15*a* via the hole 15*b*. However, while the ink supply port 15 and the joint 21 are not joined to each other, the ball 25 blocks the slit in the rubber 26 to prevent the ink from leaking via the ink supply port. On the other hand, the joint 21 comprises a seal rubber 27 that can slide inside a base member 21*a*, a supply needle 28 positioned to pass through a hole formed in the center of the seal rubber 27, and a spring 24*b* that urges the seal rubber 27 upward in the figure. The supply needle 28 is hollow and has a hole 28*a* formed on an upper side.

The ink supply port 15 and the joint 21 are joined together by their joining operation as shown in FIG. 4B. That is, the joining operation allows the base member 15*a* of the ink supply port 15 to enter the base member 21*a* of the joint 21, thus pushing down the seal rubber 27, arranged inside the joint, against the urging force of the spring 24*b*. In response to this, the supply needle 28 of the joint 21 pushes up the ball 25 in the base member 15*a* against the urging force of the spring 24*a*. Thus, the hole 28*a* in the supply needle 28 can communicate with the storing space of the ink storing container 10 via the interior of the base member 15*a* and the hole 15*b* in the base member 15*a*. As a result, the ink from the ink storing container 10 can be supplied to the head tip 22.

Figure 5A:
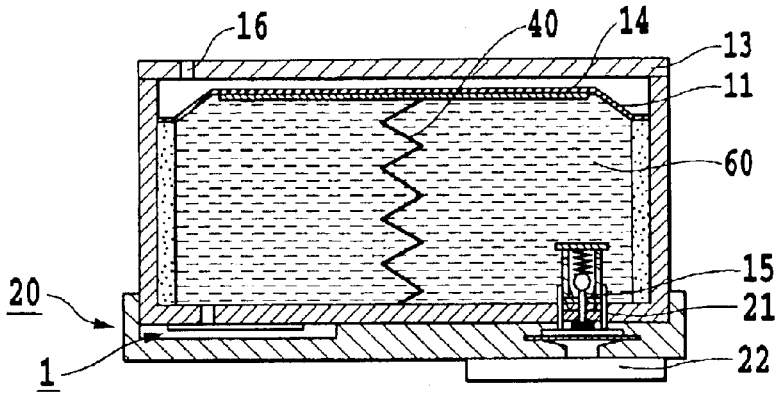
FIGS. 5A, 5B, 5C and 5D are views illustrating movement of mainly a movable member of the ink storing container and a variation in negative pressure in the ink storing space, both of which are associated with the supply of ink to the printing head, according to the configuration of the above embodiment.
Figure 5B:
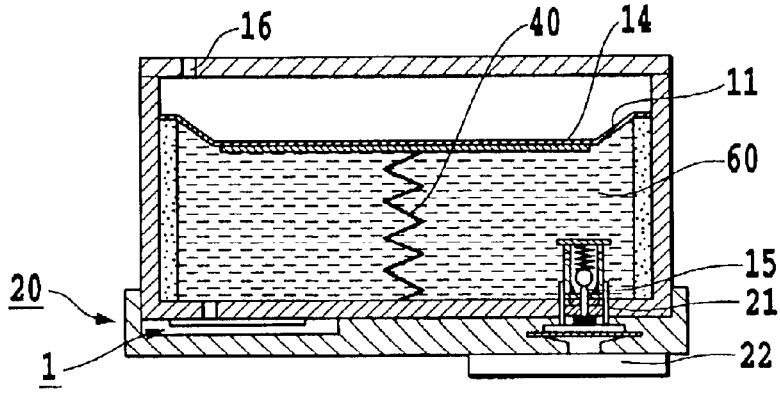
Figure 5C:
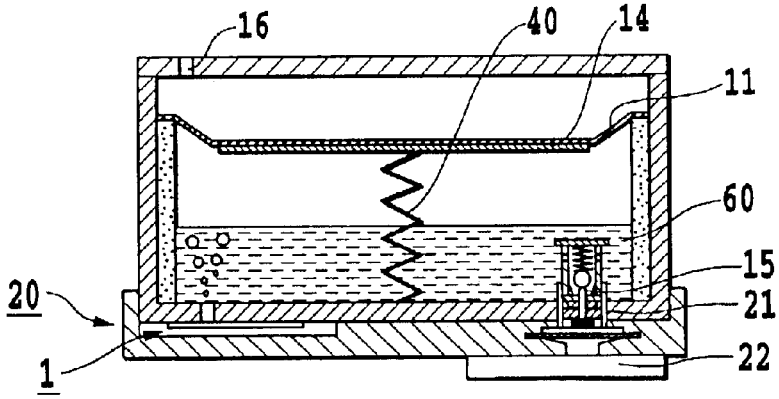

FIGS. 5A, 5B, and 5C illustrate movement of mainly the movable member 11 of the ink storing container 10 and a variation in negative pressure in the ink storing space, both of which are associated with the supply of ink to the printing head, according to the configuration of the present embodiment, described above.

FIG. 5A shows that a small amount of ink has been consumed compared to the initial state of the ink storing container 10 in which the maximum amount of ink is stored in the storing space. In such a very early stage, a surface portion on a convex side portion of the movable member 11 has a small slack and generates tensile force when the portion is deformed upward by the elastic force of the spring 40. As a result, the negative pressure is generated in the ink storing container. Subsequently, decreased volume of ink in the container as the ink is consumed causes a portion of the movable member 11, which contacts with the planar member 14, to be displaced downward. Then, the negative pressure in the container 10 increases correspondingly to mainly the elastic force of the spring 40. In this case, variations in negative pressure in this stage can be reduced to maintain the negative pressure within an appropriate range for ink supply, by setting the characteristic of variations in elastic force associated with displacement of the spring 40 at a relatively small value so as to reduce the negative pressure relative to the displacement of the planar portion 14. FIG. 5B shows a state in the final phase of this stage.

Even if the ink is further consumed, the movable member 11 can no longer be displaced, and only the tension acting on the movable member 11 increases. As a result, the negative pressure increases relatively sharply as the ink is subsequently consumed. When the pressure decreases to or below a predetermined value for air introduction pressure, the air is introduced into the storing space via the air passage section 1 as shown in FIG. 5C. Thus, the pressure (negative pressure) in the storing space does not decrease (increase) to or below (above) the predetermined value. Accordingly, the pressure in the storing space is maintained within a predetermined range. This prevents the negative pressure from increasing excessively to affect the ink supply. Therefore, the ink can be supplied stably until the ink in the storing space is substantially exhausted.

Figure 5D:
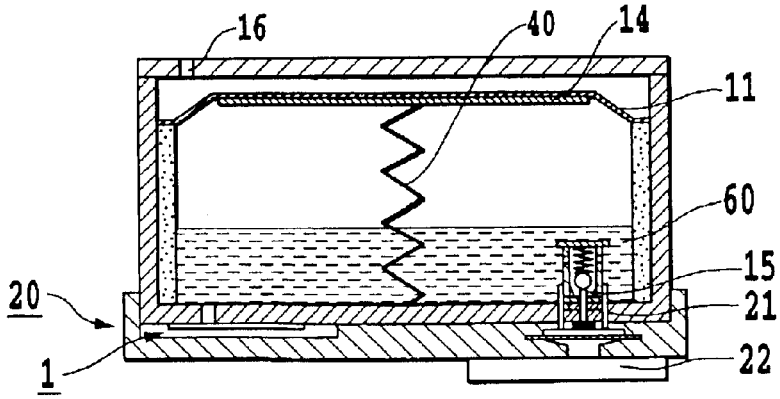

Furthermore, if a decrease in atmospheric pressure or an increase in environmental temperature causes a gas in the storing space to expand, the movable member 11 can absorb this expansion by being displaced upward, as shown in FIG. 5D. In this case, of course, the negative pressure is maintained inside the container because the spring 40 exerts force in a direction in which the movable member 11 is urged upward (the direction in which the negative pressure in the container 10 increases).

In rare cases, force may be exerted to push the ink out through the air passage section 1 if the gas in the storing section expands excessively compared to normal operating environments or if the ink storing container undergoes mechanical vibration. However, as described later in FIG. 6 and other figures, the air passage section 1 is composed of the air path and the film, so that even if the above expansion causes the ink meniscus in the air passage section 1 to be broken, the ink is kept in the air path or the film hinders the ink from passing through, correspondingly to the degree of the expansion of the gas. Consequently, the ink is prevented from leaking to the exterior. In this regard, when the air is introduced as shown in FIG. 5C, the ink meniscus in the air passage section 1 is of course broken to introduce the air from the exterior.

It should be appreciated that to allow the volume of the storing space to be increased by the introduced air, an increase in volume of the storing space caused by (upward) deformation of the movable member 11 is determined to be equal to or larger than the increase resulting from the introduced air.

Figure 6:
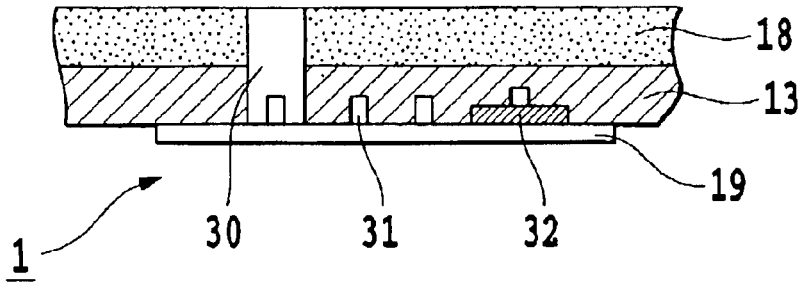
FIG. 6 is a view showing a longitudinal cross section of an air passage section of the ink storing container according to the above embodiment.
Figure 7:
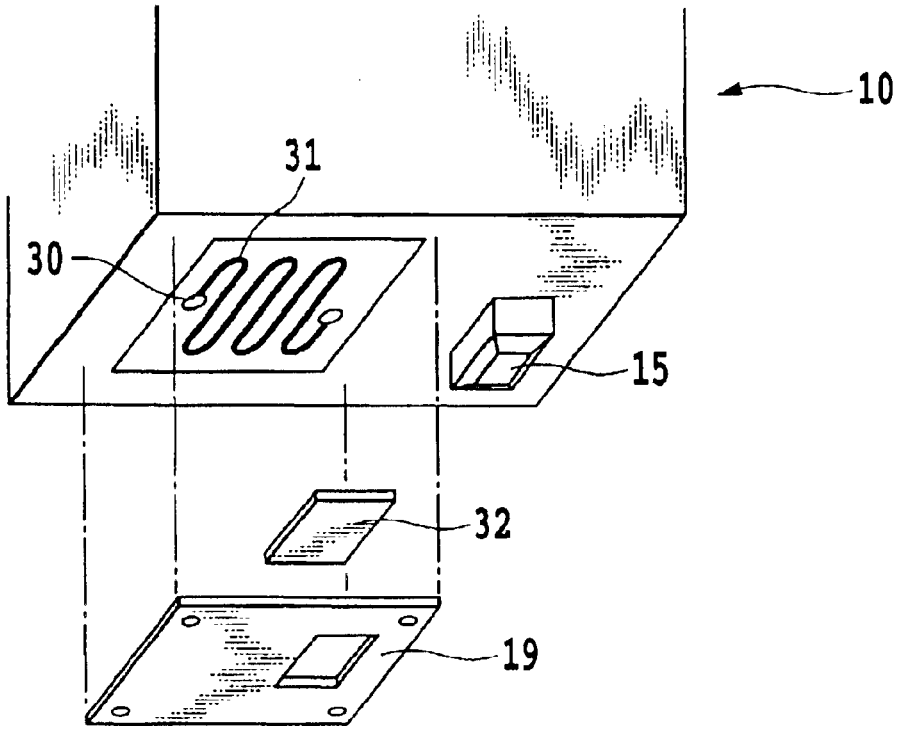
FIG. 7 is an exploded perspective view of the air passage section.

FIG. 6 is a vertical sectional view of the air passage section 1. FIG. 7 is an exploded perspective view.

As shown in these figures, the air passage section 1 is provided at a part of bottom surface of the ink storing container 10 and is composed of the air introduction port 30 formed through the enclosure member 13 and frame 18 of the container, a groove of the air path 31 which is in communication with the air introduction port 30 at one end, the film 32 provided so as to correspond to the other end of the air path 31, and the cover 19 that covers the above components to form the air path 31 and fix the film 32. The air path 31 meanders and this meandering allows a long path to be formed in relatively small area. This enables lengthening of a portion of the path in which the ink is kept when the gas in the ink storing space described in FIG. 5D expands and then flows into the path. Consequently, the ink is prevented from leaking to the exterior. Further, the film 32, provided at one end of the air path 31, has a function of passing air (gas) through, while hindering the passage of the ink. This function, in combination with the above-described function of the air path 31, perfectly prevents the leakage of the ink. This film is preferably hydrophobic in order to maintain a specified gas permeability even if the ink leaks. Further, the film need not necessarily be arranged only at one end of the air path. The film may be arranged at other positions as long as that positions include the above position. Further, the presence of the air path keeps the interior of the path humid to minimize evaporation of the liquid from the ink storing container. That is, the above described long path serves to increase resistance to diffusion of steams to minimize evaporation of the ink from the meniscus portion, thus preventing the ink from being fixed in the meniscus portion. Therefore, this ink storing container is very reliable and stable.

As already described, the above described air passage section 1 introduces air into the storing space on the basis of the negative pressure in the ink storing container. It also functions as a so-called buffer to prevent the leakage of the ink when the gas in the ink storing space expands. With the basic configuration of the air passage section 1, the ink meniscus is formed at a predetermined position of the air passage section. When air is introduced into the storing space or the gas expands, the ink meniscus is broken to introduce the air or move the ink. The air passage section according to the present embodiment, described above, has its size and the like set to form the ink meniscus at the air introduction port 31.

Figure 8A:
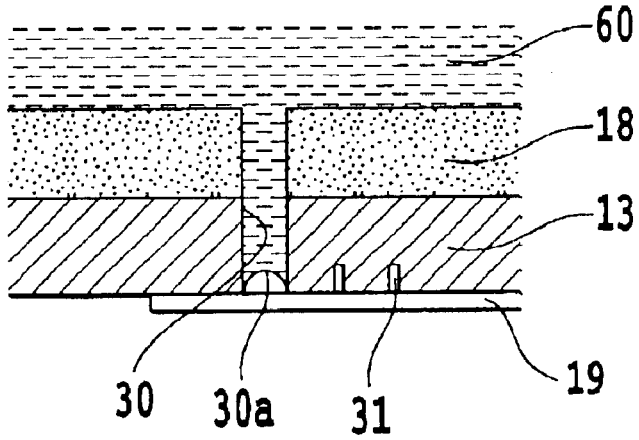
FIGS. 8A, 8B, and 8C are views illustrating the behavior of the meniscus in an air introduction port in the air passage section when an air is introduced.
Figure 8B:
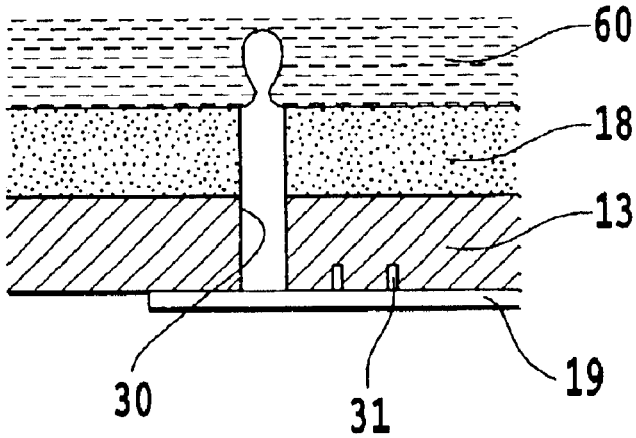
Figure 8C:
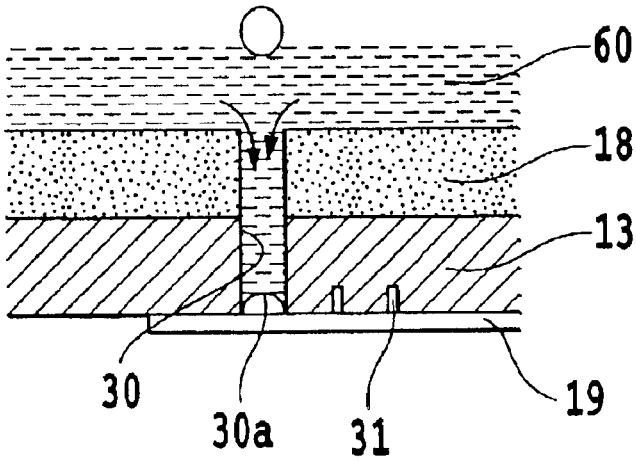

FIGS. 8A to 8C illustrate the behavior of a meniscus and the like at the air introduction port 31 when the air is introduced.

As shown in FIG. 8A, a meniscus 30*a* is formed close to the lower end of the air introduction port 31 under normal conditions. This position is of course determined by the relationship between the pressure in the storing space and the pressure in the air path 31 (the negative pressure in the storing space with respect to the printing head) and sizes such as the diameter of the air introduction port. The present embodiment is designed to form a meniscus close to the lower end.

When the negative pressure in the storing space increases, the above predetermined pressure relationship is no longer maintained. Accordingly, the formed meniscus 30*a* is broken, as shown in FIG. 8B, and the air admitted into the container via the air path 31 or the like moves to the interior of the storing space. Then, as shown in FIG. 8C, when the air is introduced to recover the pressure relationship, the meniscus 30*a* is formed again.

FIGS. 9A to 9D show various forms of the air introduction port 31.

Figure 9A:
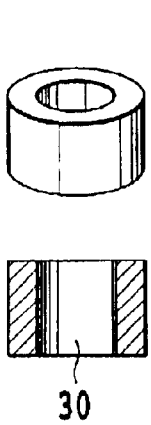
FIGS. 9A to 9D are views showing various forms of the air introduction port.

The form shown in FIG. 9A is cylindrical as shown in the above embodiment. In the form shown in FIG. 9B, a plurality of (in the illustrated example, four) holes with a diameter smaller than that of the above cylinder are formed.

Figure 9C:
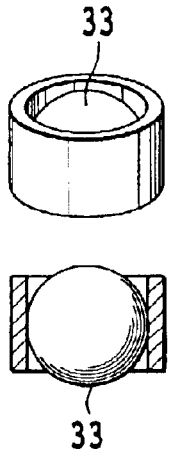
Figure 9B:
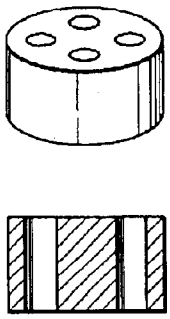
Figure 9D:
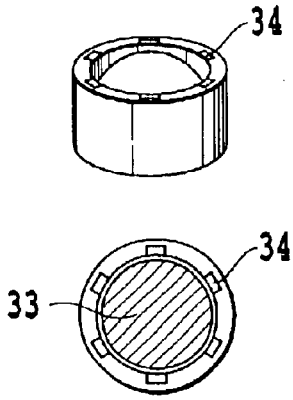

In the form shown in FIG. 9C, a spherical member 33 is disposed inside a cylinder as opposed to the above cylinder. That is, an ink meniscus is formed in the small gap between the inside of the cylinder and the spherical member 33. Further, the form shown in FIG. 9D is a cylinder in the form shown in FIG. 9C in which a plurality of grooves are formed inside. In this case, the meniscus is formed between the grooves and the spherical member 33.

Embodiment 2

Figure 10:
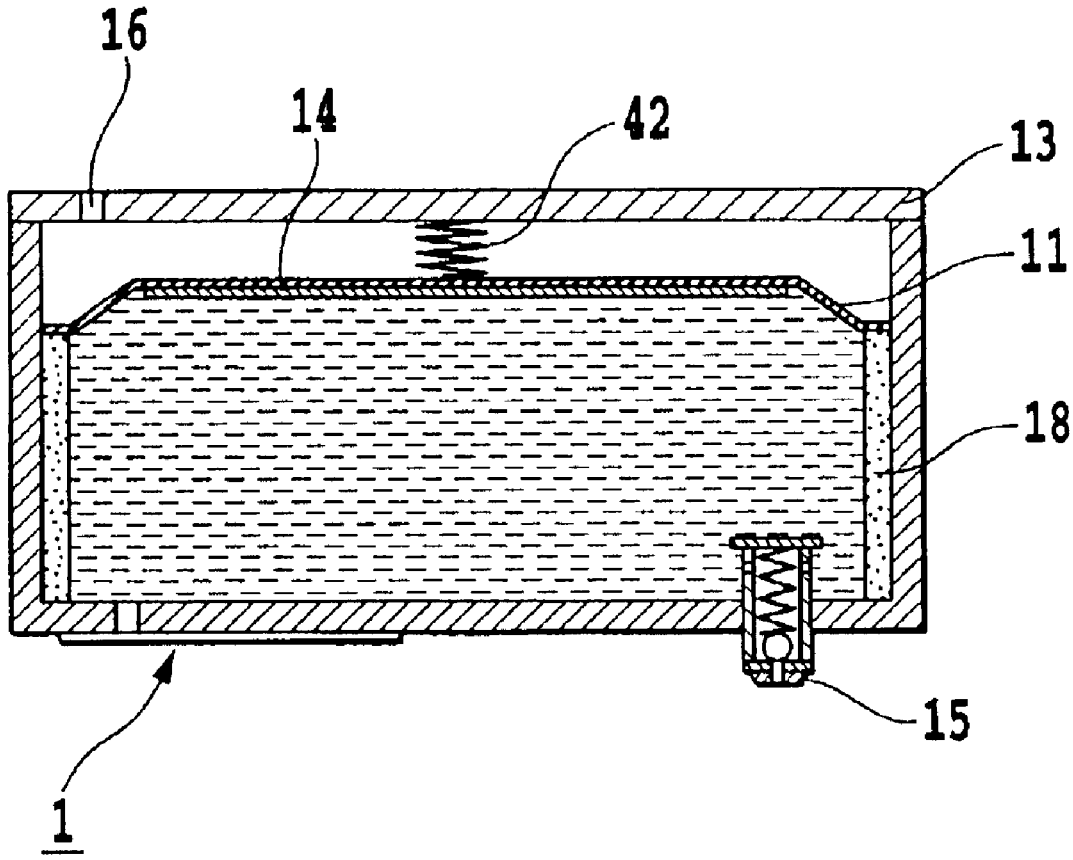
FIG. 10 is a sectional view showing an ink storing container according to a second embodiment of the present invention.

FIG. 10 is a sectional view showing an ink storing container according to a second embodiment of the present invention.

The ink storing container of the present embodiment differs from that of the first embodiment, described above, in that a spring is provided outside the ink storing space. That is, a spring 42 applies tensile force to the movable member 11 to pull it upward. With this configuration, like the above embodiment, a range of negative pressure which enables the printing head to perform an appropriate ink ejecting operation can be generated in the storing space in the ink storing container while balancing the negative pressure and the force required to hold the meniscus formed at the ejection openings in the printing head.

However, the spring 42 according to the present embodiment does not contact directly with the ink, thus eliminating the need to consider the adverse effects of the ink such as corrosion. Consequently, the spring can be preserved for a longer time and becomes more durable to increase the degree of freedom at which materials for the spring and ink are selected.

Embodiment 3

Figure 11:
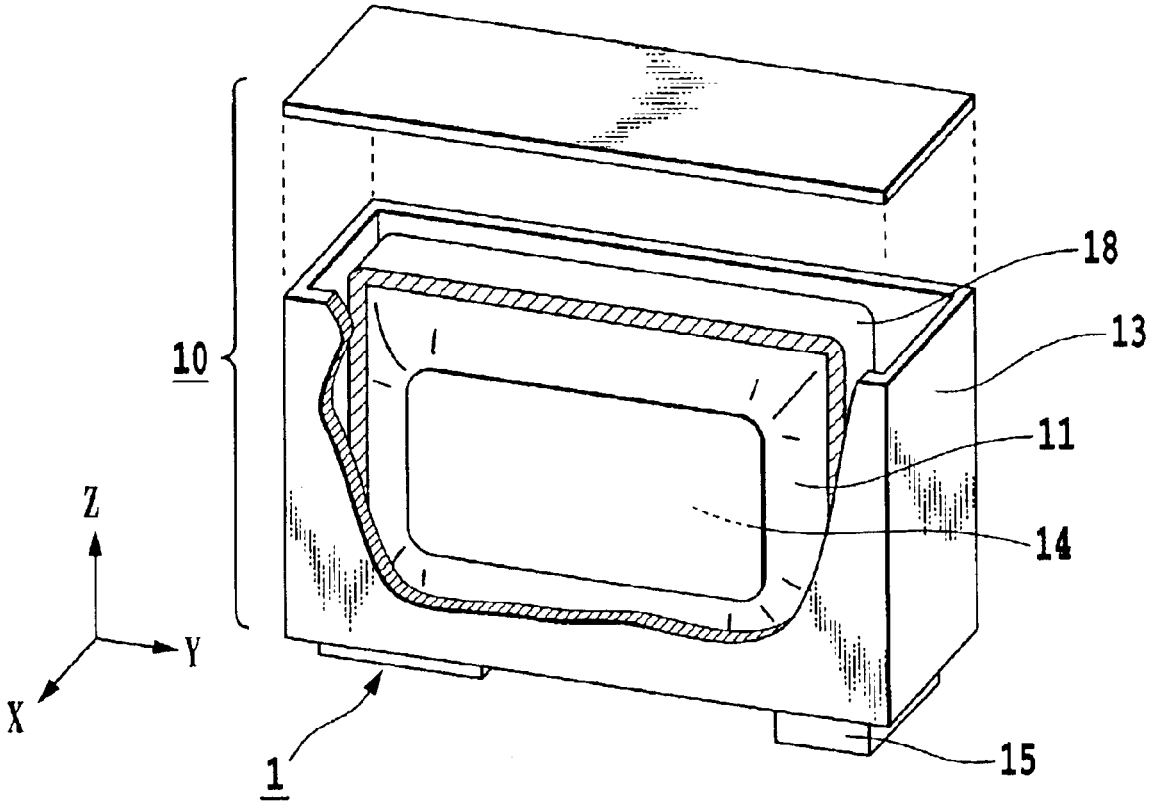
FIG. 11 is a partly broken perspective view showing an ink storing container according to a third embodiment of the present invention.
Figure 12A:
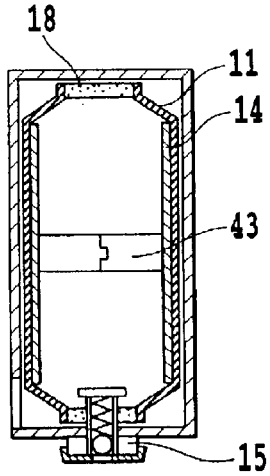
Figure 12B:
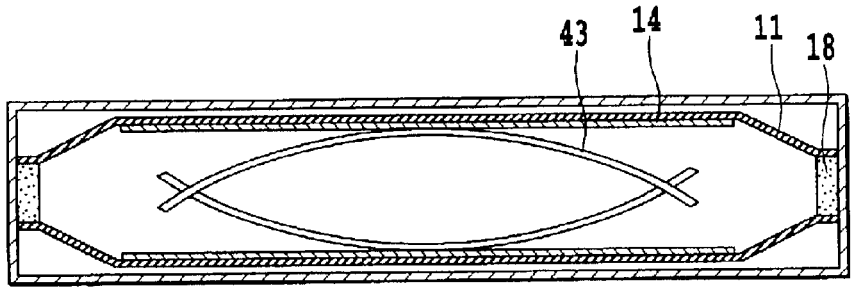
Figure 12C:
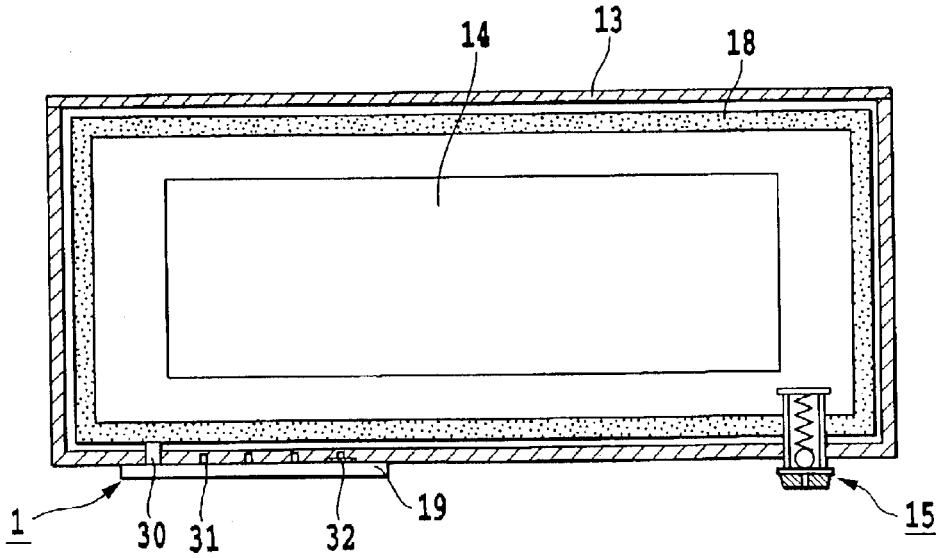

FIG. 11 is a partly broken perspective view showing an ink storing container according to a third embodiment of the present invention. FIGS. 12A, 12B, and 12C are sectional views of the ink storing container shown in FIG. 11. FIG. 12A is taken along a ZX plane in FIG. 11. FIG. 12B is taken along an XY plane. FIG. 12C shows the ink storing container as viewed from an X direction, in which side portions of the enclosure member have been removed.

As shown in these figures, the ink storing container of the present embodiment comprises a frame 18 forming a substantially rectangular ring, movable members 11 arranged at the respective sides of the frame 18, and plates 14 mounted on the respective movable members 11. Further, a spring 43 inside the storing space is formed as a pair of plate springs as opposed to the coil-like spring in the first embodiment. Except for these points, the ink storing container 10 of the present embodiment is similar to that of the first embodiment. Similar elements are denoted by the same reference numerals unless otherwise specified. Description of these elements is omitted.

The movable members 11, provided at the respective sides of the frame 18, are molded into a convex form and has a trapezoidal side cross section as in the case with the above embodiment. The air passage section 1 and the ink supply port 15 are provided in the vertically lower part of the container in a direction orthogonal to the direction in which both movable members 11 are displaced. These movable members 11 are displaced in the X direction in FIG. 11 in response to a change in the amount of ink in the storing space or a variation in pressure in the storing space. This enables the ink to be supplied appropriately as in the case with the first embodiment, described above.

Furthermore, as in the case with the first embodiment, the air passage section 1 allows the ink and the gas to behave properly because the ink meniscus formed in the air passage section is broken when air is introduced into the storing space or when the gas in the space expands.

According to this ink storing container of the present embodiment, the two movable members 11 provide the above described functions required for the movable members. This reduces the displace amount of the movable members 11 compared to the first embodiment, in which the movable member 11 is provided only at one side. As a result, restrictions on the rigidity of the movable members and the like are relaxed to widen a selection range for the movable members. Further, an additional volume can be provided to permit the movable members to be displaced, i.e. expanded in response to a change in environment. Consequently, reliability is improved. Furthermore, since both movable members are connected together by the plate springs, they are deformed in a well-balanced manner. Accordingly, the movable members properly act as buffers even when a large amount of ink is supplied.

A inner wall of the ink storing container 10 defining the storing space may be at least partly constructed using the movable members 11 such as deformable flexible films as in the above embodiments or may be entirely constructed using such members. Alternatively, instead of providing such deformable members, the container may be partly provided with members that are deformed depending on the internal volume of the storing space.

In the description of the above embodiments, the ink tank configuration is fixedly integrated with the printing head or is separably integrated with it and operated. However, the present invention is also applicable to an ink tank which is provided separately from the printing head to supply ink to the printing head via a tube or the like and which is provided with means for generating predetermined negative pressure.

Furthermore, in the above description, the present invention is applied to the ink tank from which ink is supplied to the printing head. However, the present invention is also applicable to a supply section that supplies ink to a pen as a printing section. Moreover, the present invention is applicable not only to such various printing apparatuses but also to apparatuses that supply various liquids such as drinking water and liquid seasonings or to medical fields in which drugs are supplied.

Embodiment 4

The present embodiment relates to a method of manufacturing an ink storing container according to the third embodiment, described above. In particular, the present embodiment relates to a manufacturing method used to mold a movable member composed of a sheet member, into a convex form and fix it to the frame.

FIGS. 13 to 18 illustrate a configuration of this ink storing container and its manufacturing method. The elements in these figures are denoted by reference numerals different from those of the same elements shown in FIGS. 11 and 12A to 12C.

Figure 13:
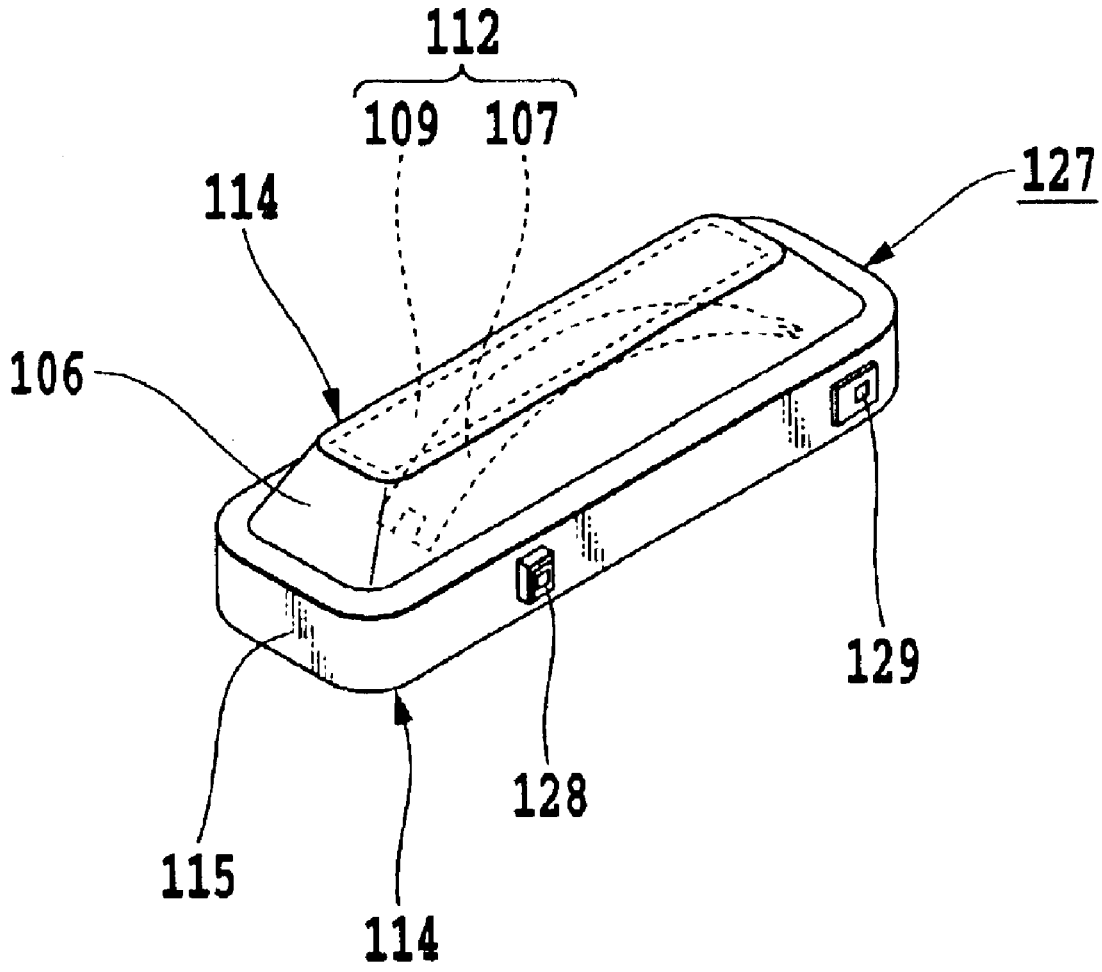
FIG. 13 is a perspective view of an ink tank according to a fourth embodiment of the present invention.

FIG. 13 is a perspective view of an ink tank (ink storing container) 127 manufactured according to the present embodiment. The ink tank 127 has a closed structure in which an upper and lower spring and sheet units 114 are attached at an upper and lower openings, respectively, in a rectangular frame 115. The spring and sheet unit 114 is composed of a spring unit 112 composed of a spring 107 and a pressure plate 109, and a flexible tank sheet (movable member) 106, as described later. The frame 115 is provided with an ink supply port 128 through which ink from the ink tank 127 is supplied to a printing head, and an air passage section 129. The air passage section 129 is configured as in the first to third embodiments, described above.

FIGS. 14A to 18B are views illustrating a manufacturing method of the ink tank 127.

Figure 14A:
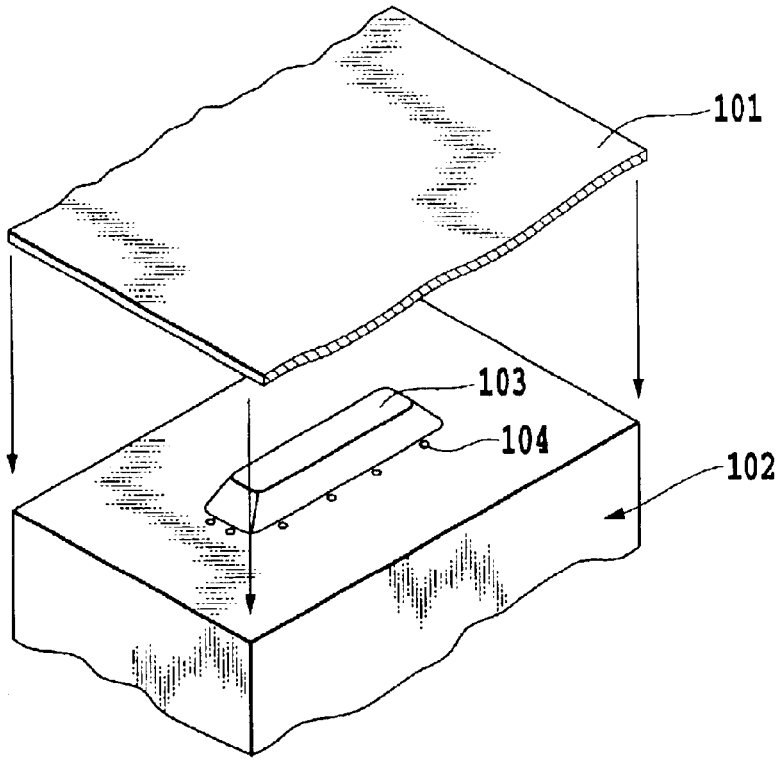
FIGS. 14A, 14B, and 14C are views illustrating a step of molding a tank sheet of the ink tank in FIG. 13.
Figure 14B:
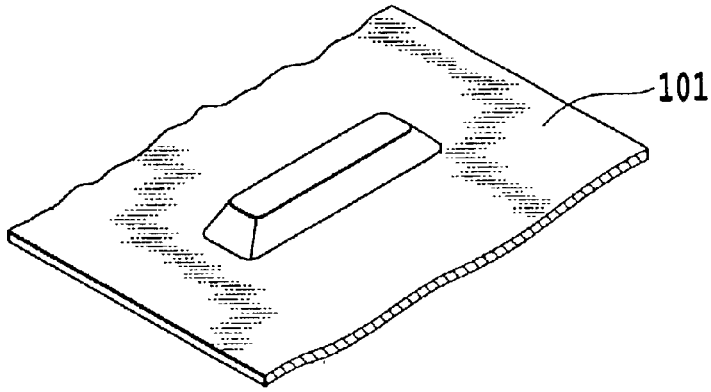
Figure 14C:
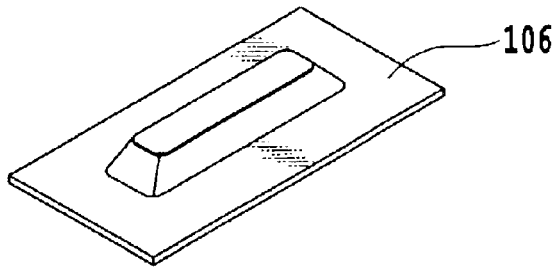

First, FIGS. 14A, 14B, and 14C illustrate steps of molding the flexible tank sheet 106 into a convex form.

A sheet material 101 as molding material for the tank sheet 106 is obtained by molding raw material into a large-sized sheet. The sheet material 101 constitutes an important factor for ink tank performance. The sheet material 101 must hinder the gas and ink components from passing through and must be flexible and durable enough to withstand repeated deformation. Preferable materials for the sheet material include PP, PE, PVDC, EVOH, and nylon. Aluminum or silica may be deposited on these materials to form composite materials. Furthermore, these materials may be stacked together. Excellent ink tank performance can be provided particularly by stacking together PP or PE, which adequately resists drugs, and PVDC, which adequately blocks the gas and steams. Further, this sheet material 101 suitably has a thickness between about 10 $\mu$m and 100 $\mu$m in view of its flexibility and durability.

The sheet material 101 is molded into a convex form using a mold 102 having a convex portion 103, vacuum holes 104, and a temperature adjusting mechanism (not shown) as shown in FIG. 14A. That is, the sheet material 101 is sucked through the vacuum holes 104 and molded into a convex form along the convex portion 103 by heat from the mold 102. After being molded into a convex form as shown in FIG. 14B, the sheet material 101 is cut into a tank sheet 106 of a predetermined size as shown in FIG. 14C. The size has only to be suitable for a manufacturing apparatus for the next step and can be set depending on the volume of the ink tank 127, in which ink is stored.

Figure 15A:
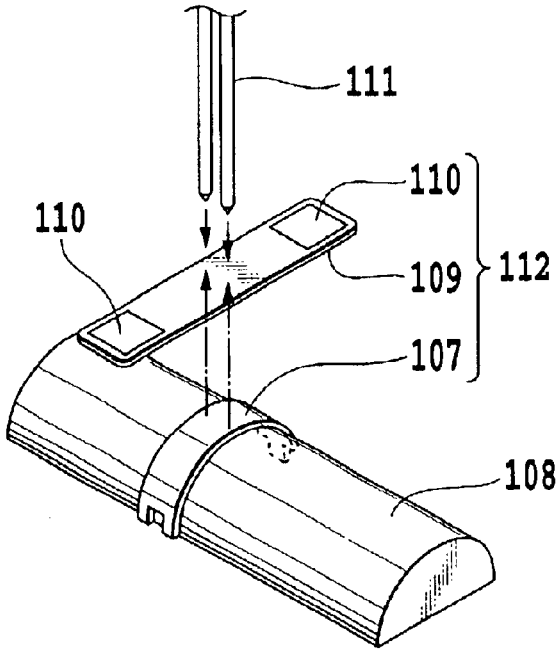
FIG. 15A is a view illustrating a step of manufacturing a spring unit of the ink tank in FIG. 13.

FIG. 15A illustrates a step of manufacturing the spring unit 112, used to maintain negative pressure inside the ink tank 127. The spring 107 already formed like a semicircle is fitted around a spring receiving jig 108. Then, a pressure plate 109 is attached to the spring by spot welding using a welding electrode 111. Thermal adhesion material 110 is mounted on the pressure plate 109. The spring 107 and the pressure plate 109 constitute the spring unit 112.

Figure 15B:
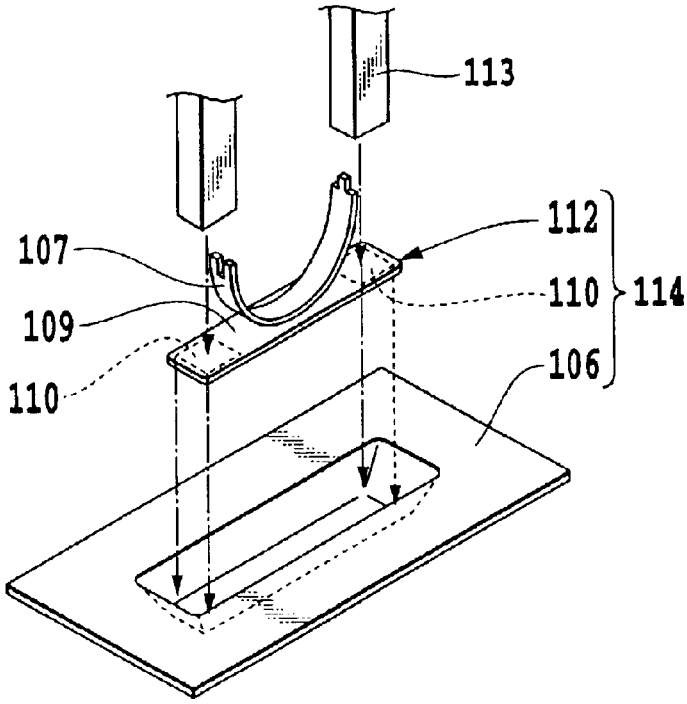
FIG. 15B is a view illustrating a step of manufacturing a spring and sheet unit.

FIG. 15B illustrates a step of fitting the spring unit 112 on the tank sheet 106. The spring unit 112 is positioned and set on the inner surface of the tank sheet 106 placed on a receiving jig (not shown). Then, a heat head 113 is used to heat the thermal adhesion material 110 to stick the spring unit 112 and the tank sheet 106 together. Thus, the spring and sheet unit 114 is obtained.

Figure 16A:
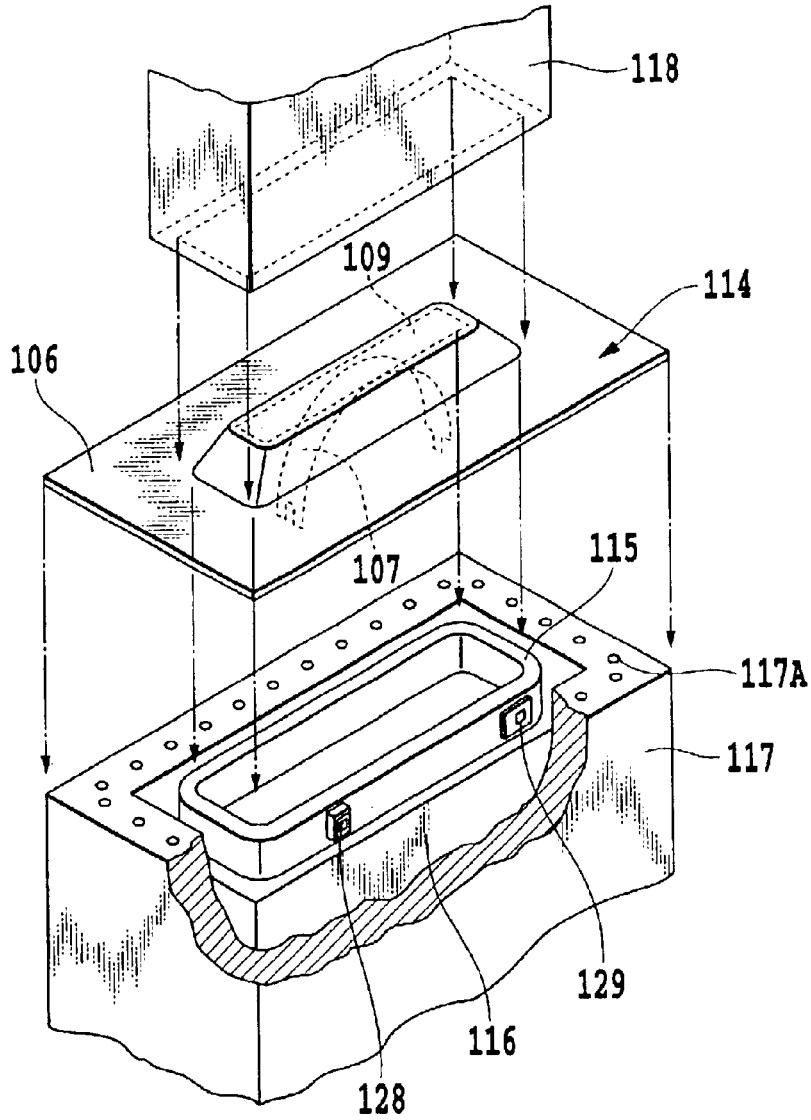
FIGS. 16A and 16B are views of a step of manufacturing a spring, sheet, and frame unit of the ink tank in FIG. 13.

FIGS. 16A illustrates a step of welding the spring and sheet unit 114 to the frame 115. The frame 115 is fixed to a frame receiving jig 116. After the frame 115 has been positioned and arranged, a sheet sucking jig 117 surrounding the frame 115 sucks the spring and sheet unit 114 onto vacuum holes 117A to hold the unit 114 and the frame 115 so as to avoid relative misalignment. Subsequently, a heat head 118 is used to thermally weld together annular joining surfaces of peripheral portion of the frame 115, shown in the upper part of the figure, and of tank sheet 106. The sheet sucking jig 117 allow the peripheral portion of the frame 115, shown in the upper part of FIG. 16A, to uniformly face a peripheral portion of tank sheet 106 of the tank sheet 106, so that these joining surfaces are very uniformly thermally welded and sealed. Therefore, the sheet sucking jig 117 is important in carrying out thermal welding in order to obtain a uniform seal.

Figure 16B:
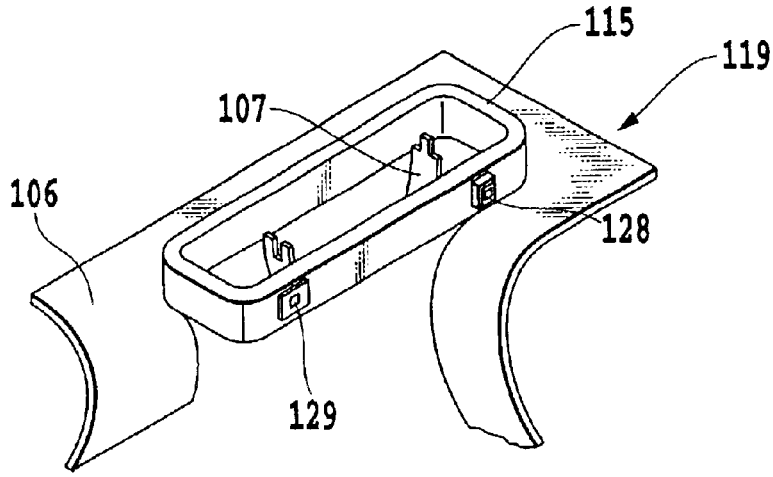

FIG. 16B illustrates a step of using a cutter (not shown) to cut a portion of the tank sheet 106 which protrudes from the frame 115. By thus cutting the portion of the tank sheet 106 which protrudes from the frame 115, the spring, sheet, and frame unit 119 is completed.

Figure 17:
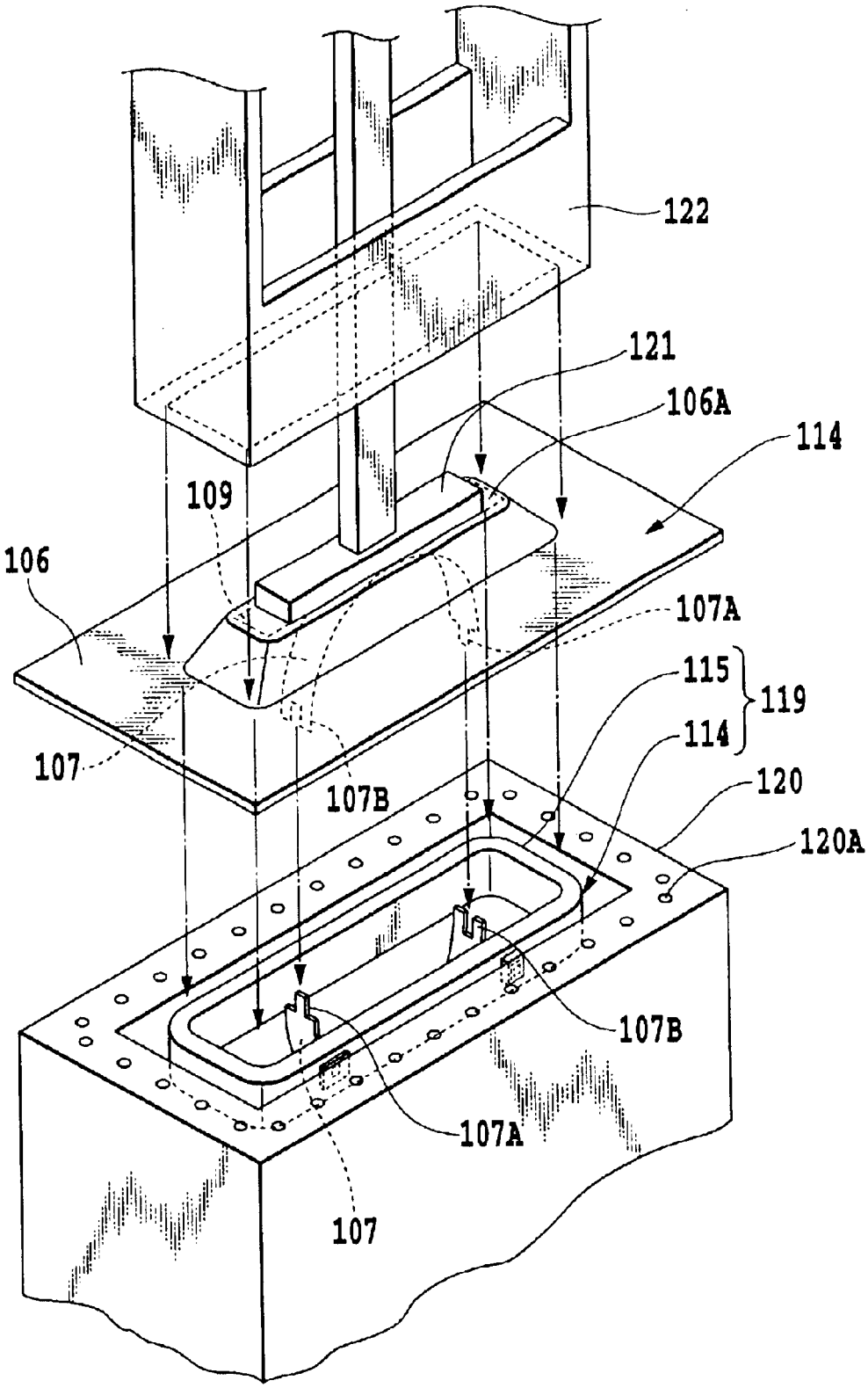
FIG. 17 is a view of a step of combining the spring and sheet unit with the spring, sheet, and frame unit of the ink tank in FIG. 13.
Figure 18A:
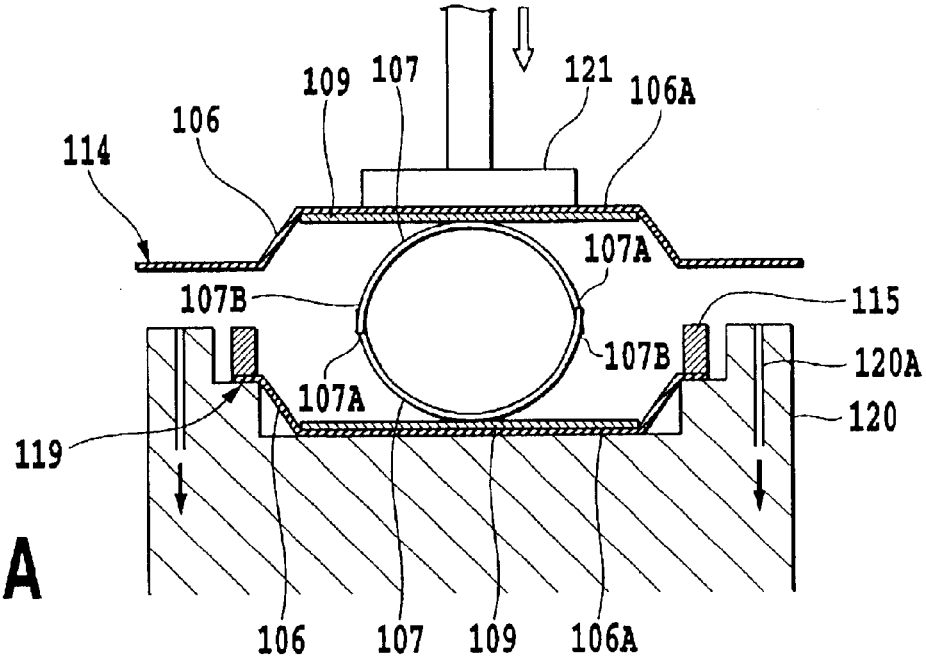
FIGS. 18A and 18B are sectional views of an essential part of the combining process in FIG. 17.
Figure 18B:
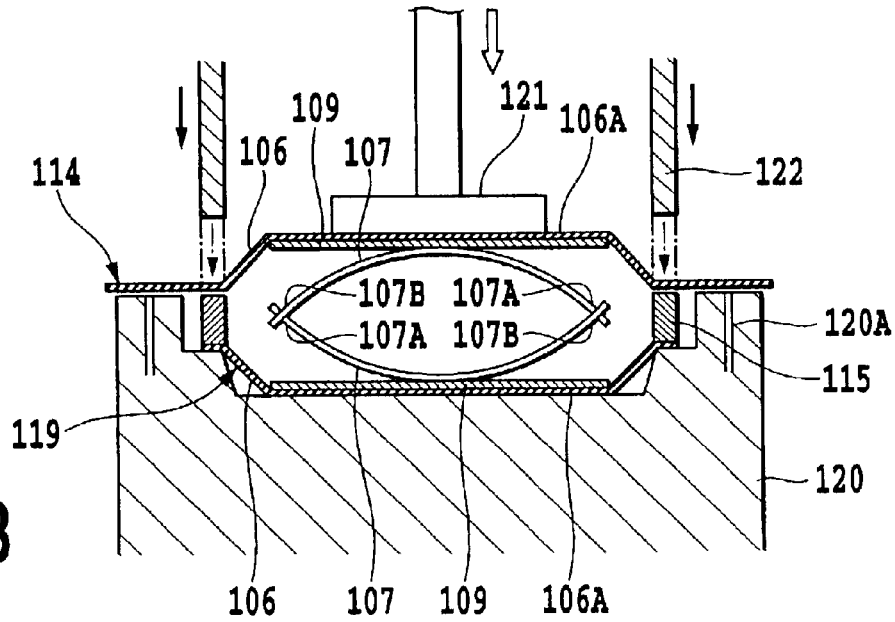

FIGS. 17, 18A, and 18B illustrate a step of thermally welding the spring and sheet unit 114, produced in the previously described step, to the spring, sheet, and frame unit 119.

As shown in FIG. 17, the spring, sheet, and frame unit 119 is mounted on a receiving jig (not shown) and has its outer peripheral portion surrounded by a sucking jig 120 positioned relative to the jig. The receiving jig is in surface contact with a planar portion 106A of outer surface of the tank sheet 106 of the spring, sheet, and frame unit 119 to hold the planar portion 106A as shown in FIGS. 18A and 18B. The planar portion 106A of outer surface of the tank sheet 106 of the spring and sheet unit 114 is sucked and held by a presser jig 121, which is then lowered. Thus, tip portions 107A and 107B of spring 107 of the spring and sheet unit 114 are substantially simultaneously fitted into tip portions 107A and 107B of spring 107 of the spring, sheet, and frame unit 119. That is, one tip portion 107A of the spring 107 is convex and the other tip portion 107B is concave so that they can be fitted into each other on the basis of self-alignment. These springs 107 are combined together as a pair of spring member constituents to constitute one spring member.

Furthermore, the presser jig 121 is lowered to compress the pair of springs 107 as shown in FIG. 18A. At this time, the presser jig 121 presses the planar portion 106A of the spring and sheet unit 114, located in the upper part of FIG. 17, i.e. a large upper flat area of the tank sheet 106, formed to be convex. This regulates the position of the planar portion 106A of the tank sheet 106 to cause the spring and sheet unit 114 to approach the lower unit 119 and jig 120 while maintaining its horizontal position. Consequently, as shown in FIG. 18B, a peripheral portion of tank sheet 106 of the spring and sheet unit 114 comes into contact with a surface of the sucking jig 120 and is sucked and held by the vacuum holes 120A. The peripheral portion also uniformly faces a welding surface (the upper joining surface in the figure) of the frame 115. In this state, a heat head 122 is used to thermally weld together annular joining surfaces of peripheral portion of the frame 115 of the spring, sheet, and frame unit 119, shown in the upper part of the figure, and of tank sheet 106 of the tank sheet 106.

The ink tank 127 in which high parallelism is maintained between the planar portions 106A of the pair of tank sheets 106 can be mass-produced stably by thus compressing the pair of springs 107 while maintaining the parallelism between the planar portion 106A of tank sheet 106 of the upper unit 114 and the planar portion 106A of tank sheet 106 of the lower unit 119. Further, the pair of springs 107 are compressed and deformed uniformly in the lateral direction of FIGS. 18A and 18B. This avoids generation of such force as tilts the spring and sheet unit 114 to allow stable production of the ink tank 127 in which high parallelism is maintained between the planar portions 106A of the pair of tank sheets 106. Furthermore, the pair of springs 107 are compressed and deformed uniformly in the lateral direction of FIGS. 18A and 18B as the internal volume of the ink tank 127 varies. The spacing between the planar portions 106A of the pair of tank sheets 106 varies with high parallelism maintained between the planar portions 106A. As a result, ink can be supplied stably. Moreover, there is no possibility of generating such excessive force as tilts the planar portion 106A of the flexible tank sheet 106. This improves the sealing capability, pressure resistance, and durability of the ink tank 127.

Subsequently, the ink tank 127 in FIG. 13 is completed by cutting a portion of the tank sheet 106 which protrudes from the frame 115. The interior of the ink tank 127 has a closed structure that is in communication with the exterior only through the first ink supply port 128 and the second ink supply port 129.

Figure 19:
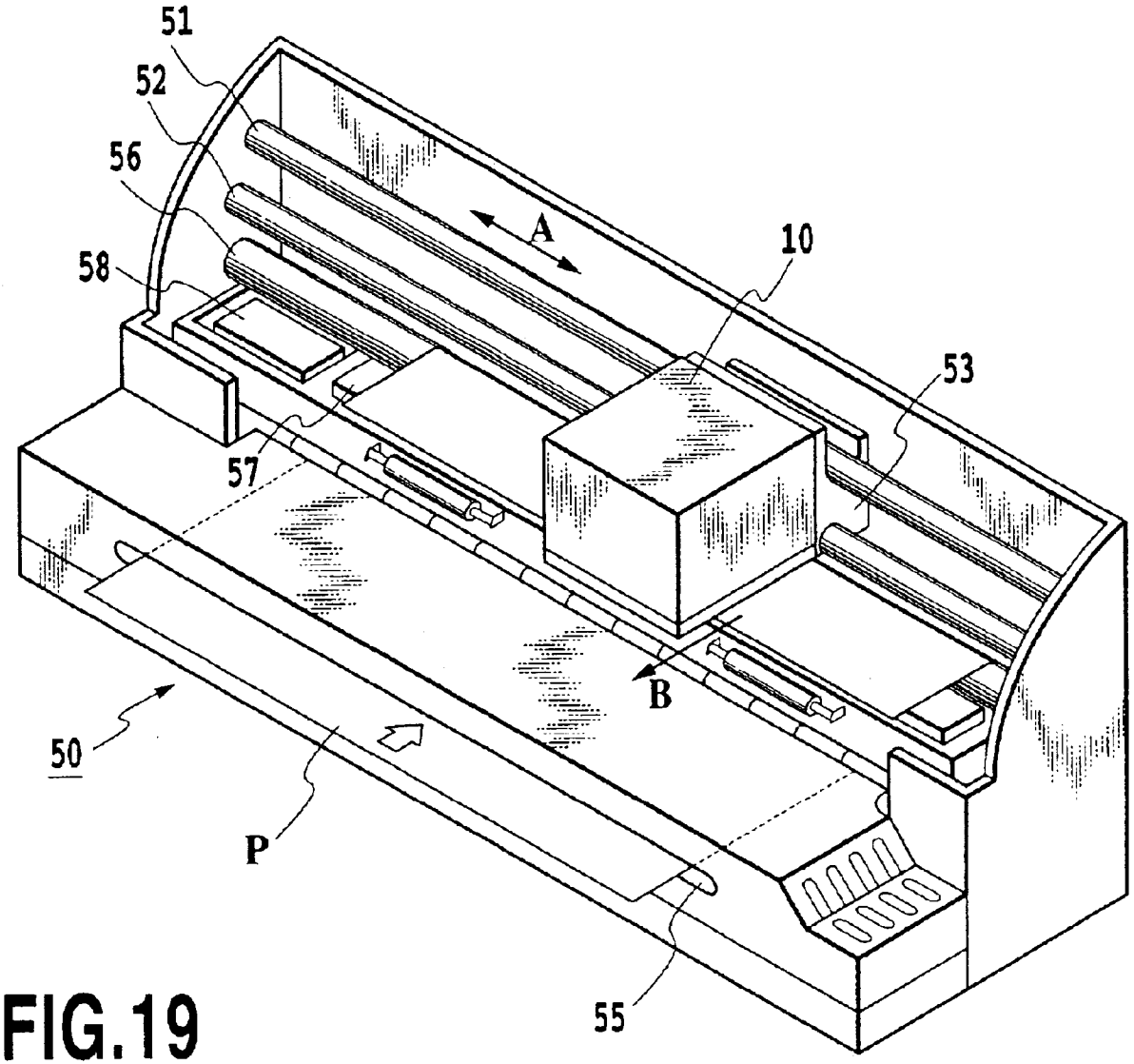
FIG. 19 is a perspective view showing an example of an ink jet printing apparatus using the ink storing container and printing head according to the above embodiments.

FIG. 19 is a perspective view showing an example of a configuration of an ink jet printing apparatus using the ink storing container (ink tank) or ink jet cartridge according to the above described embodiments.

A printing apparatus 50 of the present embodiment is of an ink jet type based on a serial scan method. A carriage 53 is guided by guide shafts 51 and 52 so as to be movable in a main scanning direction, shown by arrow A. The carriage 53 is reciprocated in the main scanning direction by a carriage motor and a drive force transmitting mechanism such as a belt which transmits the drive force of the carriage motor. The carriage 53 is provided with the ink jet printing head 20 (not shown in FIG. 19) and the ink tank (ink storing container) 10 from which ink is supplied to the ink jet printing head 20. The ink jet printing head 20 and the ink tank 10 are configured as in the above described embodiments. They may constitute an ink jet cartridge. A sheet P as a print medium is inserted through an insertion port 55 formed in a front end of the apparatus. Then, the sheet P has its transportation direction reversed and is then transported in a sub-scanning direction by a feed roller 56. The printing apparatus 50 sequentially prints an image on the sheet P by repeating a printing operation of ejecting ink to a print area of the sheet P on a platen 57 while moving the printing head 20 in the main scanning direction and a transporting operation of transporting the sheet P in the sub-scanning direction by a distance corresponding to a print width.

The ink jet printing head 20 may utilize thermal energy generated by an electro-thermal converter to eject ink. In this case, the electro-thermal converter generates heat to cause film boiling so that the resulting bubbling energy can be used to eject ink through ink ejection openings. Further, an ink ejecting method for the ink jet printing head 20 is not limited to the one using an electro-thermal converter. For example, it is possible to use a method of ejecting ink using, for example, a piezoelectric element, or the like.

A recovery system unit (recovery process means) 58 is provided at a left end, in FIG. 19, of movement area of the carriage 53 and opposite an ink ejection opening formed surface of the ink jet printing head 20 mounted on the carriage 53. The recovery system unit 58 comprises a cap that can cap the ink nozzles in the printing head 20, a suction pump that can generate negative pressure in the cap, and the like. To maintain a good ink ejection state, a recovery process (also referred to as a "suction recovery process") is executed by generating negative pressure in the cap covering the ink nozzles to suck and discharge ink from the ink nozzles. Alternatively, to maintain a good ink ejection state, a recovery process (also referred to as a "ejection recovery process") may be executed by ejecting ink that does not contribute to images, into the cap through the ink ejection openings.

In the printing apparatus of the present embodiment, ink is supplied from the ink tank 10, mounted on the carriage 53 together with the ink jet printing head 20, to the ink jet printing head 20.

With the above embodiments of the present invention, the movable member is molded into a convex form, so that even the liquid storing container of a small capacity can maintain a stable capacity. Further, the movable member can exhibit predetermined rigidity. Furthermore, the movable member can remain planar when fixed to, for example, a frame. Therefore, when the movable member is welded or stuck, problems such as wrinkling of their welding or sticking surfaces can be prevented.

Further, the ink storing container is provided with the air passage section in which a meniscus is formed correspondingly to pressure relative to an atmosphere and in which the interior of the liquid storing space is in communication with the atmosphere via the path having a predetermined length. This allows an air to be introduced into the space via the air passage section, when the negative pressure in the storing space increases. On the other hand, when the air in the liquid storing space expands to push the liquid out the storing space, the liquid can be kept in the path.

As a result, it is possible to improve the assembly stability and volume stability of the liquid storing container, increase volume efficiency, and maintain stable negative pressure characteristics regardless of liquid consumption stages. Further, a liquid such as ink is prevented from leaking regardless of a variation in the internal pressure of the liquid storing section which variation is caused by a change in environment. Therefore, it is possible to make the container more reliable.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A liquid storing container from which a liquid is supplied to an exterior and in which the liquid is stored, said liquid storing container comprising:

a deformable movable member which forms part of said container and has a portion molded into a convex form;

negative pressure generating means for applying force to said movable member, an applying direction of said force being a direction opposite to a direction in which said movable member is deformed as the liquid is supplied, to maintain an interior of the container at negative pressure with respect to atmosphere;

a frame member which forms part of said container and which fixes said deformable movable member at a peripheral section thereof, said frame member having an opening to allow the liquid to be extracted to the exterior;

a plate member provided on a portion of the convex form of said deformable movable member; and an air passage section including an air introduction port in which a liquid meniscus is formed corresponding to pressure relative to the atmosphere and a path having a predetermined length so that the interior of said container communicates with the atmosphere via said path and said air introduction port;

wherein said deformable movable member includes a deformable area between said frame member and said plate member, and said deformable area deforms according to extraction of the liquid from said container.

2. A liquid storing container as claimed in claim 1, wherein said path is a meandering path.

3. A liquid storing container as claimed in claim 1, wherein a hydrophobic film is further provided at at least one end of said path.

4. A liquid storing container as claimed in claim 1, wherein when the pressure in said container reaches a predetermined value or smaller, the liquid meniscus at said air introduction port is broken, and then said air passage section introduces air into said container via said air introduction port and said path.

5. A liquid storing container as claimed in claim 1, wherein said movable member is provided at each side of said frame member.

6. A liquid storing container as claimed in claim 1, wherein said negative pressure generating means has a coil spring which applies said force.

7. A liquid storing container as claimed in claim 1, wherein said negative pressure generating means has a plate spring which applies said force.

8. A liquid storing container as claimed in claim 1, wherein said liquid is ink used to perform printing on a printing medium.

9. An ink jet cartridge comprising:

an ink storing container from which ink is supplied to an exterior and in which the ink is stored, said ink storing container comprising:

a deformable movable member which forms part of said container and has a portion molded into a convex form;

negative pressure generating means for applying force to said movable member, an applying direction of said force being a direction opposite to a direction in which said movable member is deformed as the ink is supplied, to maintain an interior of the container at negative pressure with respect to atmosphere;

a frame member which forms part of said container and which fixes said deformable movable member at a peripheral section thereof, said frame member having an opening to allow the ink to be extracted to the exterior;

a plate member provided on a portion of the convex form of said deformable movable member;

an air passage section including an air introduction port in which an ink meniscus is formed corresponding to pressure relative to the atmosphere and a path having a predetermined length so that the interior of said container communicates with the atmosphere via said path and said air introduction port, and a printing head ejecting the ink, which is supplied from said ink storing container;

wherein said deformable movable member includes a deformable area between said frame member and said plate member, and said deformable area deforms according to extraction of the ink from said container.

10. An ink jet cartridge as claimed in claim 9, wherein said path is a meandering path.

11. An ink jet cartridge as claimed in claim 9, wherein a hydrophobic film is further provided at at least one end of said path.

12. An ink jet cartridge as claimed in claim 9, wherein when the pressure in said container reaches a predetermined value or smaller, the ink meniscus at said air introduction port is broken, and then said air passage section introduces air into said container via said air introduction port and said path.

13. An ink jet cartridge as claimed in claim 9, wherein said movable member is provided at each side of said frame member.

14. An ink jet cartridge as claimed in claim 9, wherein said negative pressure generating means has a coil spring which applies said force.

15. An ink jet cartridge as claimed in claim 9, wherein said negative pressure generating means has a plate spring which applies said force.

16. An ink jet cartridge as claimed in claim 9, wherein the ink is ink used to perform printing on a printing medium.

17. An ink jet cartridge as claimed in claim 9, wherein said printing head utilizes thermal energy to generate bubbles in the ink so that pressure of the bubbles causes the ink to be ejected.

18. An ink jet printing apparatus which performs printing by using a printing head to eject ink to a printing medium, wherein said ink jet printing apparatus uses an ink storing container from which ink is supplied to the printing head and in which the ink is stored, said ink storing container comprising:

a deformable movable member which forms part of said container and has a portion molded into a convex form;

negative pressure generating means for applying force to said movable member, an applying direction of said force being a direction opposite to a direction in which said movable member is deformed as the ink is supplied, to maintain an interior of the container at negative pressure with respect to atmosphere;

a frame member which forms part of said container and which fixes said deformable movable member at a peripheral section thereof, said frame member having an opening to allow the ink to be extracted to the exterior;

a plate member provided on a portion of the convex form of said deformable movable member; and an air passage section including an air introduction port in which an ink meniscus is formed corresponding to pressure relative to the atmosphere and a path having a predetermined length so that the interior of said container communicates with the atmosphere via said path and said air introduction port;

wherein said deformable movable member includes a deformable area between said frame member and said plate member, and said deformable area deforms according to extraction of the ink from said container.

19. A liquid storing container from which a liquid is supplied to an exterior and in which the liquid is stored, said liquid storing container comprising:

a deformable movable member which forms part of said container and has a portion molded into a convex form;

negative pressure generating means for applying force to said movable member, an applying direction of said force being a direction opposite to a direction in which said movable member is deformed as the liquid is supplied, to maintain an interior of the container at negative pressure with respect to atmosphere;

a frame member which forms part of said container and which fixes said deformable movable member at a peripheral section thereof, said frame member having an opening to allow the liquid to be extracted to the exterior;

a plate member provided on a portion of the convex form of said deformable movable member; and an air passage section including an air introduction port in which a liquid meniscus is formed corresponding to pressure relative to the atmosphere and a path having a predetermined length so that the interior of said container communicates with the atmosphere via said path and said air introduction port;

wherein said deformable movable member includes a deformable area between said frame member and said plate member, and said deformable area deforms according to extraction of the liquid from said container; and wherein said plate member is displaced after said deformable area deforms according to the extraction of said liquid.

* * * * *